US006468621B1

(12) United States Patent
Landau

(10) Patent No.: US 6,468,621 B1
(45) Date of Patent: Oct. 22, 2002

(54) REVERSIBLE COTTON BATHROOM RUG AND METHOD OF MANUFACTURE

(75) Inventor: Mordechai Landau, Ganei Yehuda (IL)

(73) Assignee: Caesarea Wardinon Industries Ltd., Or-Akiva (IL)

( * ) Notice: Subject to any disclaimer, the term of this patent is extended or adjusted under 35 U.S.C. 154(b) by 0 days.

(21) Appl. No.: 09/458,556

(22) Filed: Dec. 9, 1999

(30) Foreign Application Priority Data

Nov. 5, 1999 (IL) ..... 132776

(51) Int. Cl.[7] ..... B32B 3/02

(52) U.S. Cl. ..... 428/89; 428/95; 428/92; 112/410

(58) Field of Search ..... 428/89, 92, 95; 15/215; 26/18.5; 112/410; 8/116.1, 137

(56) References Cited

U.S. PATENT DOCUMENTS

| | | | | | |
|---|---|---|---|---|---|
| 2,482,682 | A | * | 9/1949 | Moore | 112/410 |
| 2,486,963 | A | * | 11/1949 | Miller | 112/410 |
| 2,499,406 | A | * | 3/1950 | Miller | 112/410 |
| 2,662,227 | A | * | 12/1953 | Lacey | 112/1 |
| 2,713,012 | A | * | 7/1955 | Hartstein | |
| 4,426,415 | A | * | 1/1984 | Avery | 428/17 |
| 4,439,478 | A | * | 3/1984 | Guild | 428/96 |
| 4,609,580 | A | * | 9/1986 | Rockett et al. | 428/198 |
| 4,614,679 | A | * | 9/1986 | Farrington, Jr. et al. | 428/138 |
| 5,380,574 | A | * | 1/1995 | Katoh et al. | 428/92 |
| 5,652,038 | A | * | 7/1997 | Geren | 428/92 |
| 6,367,398 | B1 | * | 4/2002 | Landau | 112/410 |
| 2001/0023157 | A1 | * | 9/2001 | Sheppard, Jr. | 442/203 |

FOREIGN PATENT DOCUMENTS

| | | | |
|---|---|---|---|
| DE | 100 54 518 | * | 5/2001 |
| GB | 2 355 927 | * | 5/2001 |
| JP | 05-161559 | * | 6/1993 |

* cited by examiner

*Primary Examiner*—Cheryl A. Juska
(74) *Attorney, Agent, or Firm*—Brown, Raysman, Millstein, Felder & Steiner LLP

(57) ABSTRACT

An integrally tufted tumble twist loop—cut loop reversible rug comprising:

a first layer of cotton material, a second layer of cotton material overlaying the first layer of cotton material thereby forming a two layer cotton backing material, said first and second layers of cotton material having different shrink coefficients, a first pile yarn tufted through the two layer backing material in a tumble twist loop on one side and a cut loop on the other side of the backing material, a second pile yarn tufted through the two layer backing material in the same direction as the first pile yarn in a cut loop, said first and second tufted yarns being skewed between the first and second cotton layer materials.

6 Claims, 1 Drawing Sheet

REVERSIBLE COTTON BATHROOM RUG AND METHOD OF MANUFACTURE

FIELD OF THE INVENTION

This invention relates to a reversible cotton rug and particularly to a rug having twisted loops on one side and cut loops on the other side, and to a method for manufacturing same.

BACKGROUND OF THE INVENTION

Rugs such as scatter rugs or bathroom rugs are well known. Generally, these rugs are made of soft cotton or synthetic yarns, and in the case of bathroom rugs, may also be water absorbent so that when a person steps unto them coming out from a shower or bathtub the water drops falling on the mat do not accumulate in pools.

Rugs, in general, comprise a tufted fabric having a raised surface of yarn tufts on one side of a primary backing material and a latex under layer to adhere the yarn tufts to the backing. The yarn, such as pile yarn, can be either cut or looped or partly cut and partly looped, to form cut, looped or sculptured rugs on one side only, the other side being either latex or left bare. The backing material is usually made of cotton or synthetic woven or non-woven material. The tufts can be cotton pile or of synthetic fibers. Nylon, and other synthetic filaments such as polyester, have predominantly been utilized as the yarns for tufting bathroom mats because of the resiliency, bulk and strength provided by this type of yarn. Tufting denier nylon filaments have been developed that have the luster level and hand of cotton while retaining the resilience, strength and performance of nylon. Unfortunately these synthetic yarns do not have the absorbency of cotton and are essentially hydrophobic.

More recently, yarn producers have developed a hydrophilic micro-denier nylon with the absorbency characteristics of cotton or other natural fibers. These nylons are suitable for use in garment fabrics, particularly for sports apparel, to wick moisture from one side of the fabric to the other side of the fabric away from the skin of the wearer or to disburse the moisture throughout the fabric for quick drying of the fabric and to keep the side of the fabric in contact with the skin of the wearer in a dry state. This micro-denier nylon is not practical for use in tufted fabrics of the type considered for bathroom mats since it would be too expensive to produce a filament end in the tufting denier range.

U.S. Pat. No. 5,652,038 discloses a tufted fabric and yarn for use in bathroom rugs wherein each of the yarn tufts includes hydrophilic micro-denier filaments for wicking and distribution of moisture throughout the raised surface of the fabric and hydrophobic tufting denier filaments for providing resiliency, bulk and strength to the fabric.

OBJECT OF THE INVENTION

It is the object of the present invention to provide a reversible rug with one side of the rug having high twisted loops, which we shall call "tumble twist" loops.

Another object of the present invention is to provide a reversible cotton rug having on one side tufted cut yarn.

Still another object of the invention is to provide a reversible cotton rug with tumble twist loops without an adhesive backing.

Yet another object of the invention is to provide an integrally tufted tumble twist loop—cut loop reversible cotton rug.

A further object of the invention to provide a method of manufacturing an integrally tufted tumble twist loop—cut loop cotton reversible rug.

SUMMARY OF THE INVENTION

In accordance with this invention there is provided an integrally tufted tumble twist loop—cut loop reversible rug comprising:

a first layer of cotton material, a second layer of cotton material overlaying the first layer of cotton material thereby forming a two layer cotton backing material, said first and second layers of cotton material having different shrink coefficients, a first pile yarn tufted through the two layer backing material in a tumble twist loop on one side and a cut loop on the other side of the backing material, a second pile yarn tufted through the two layer backing material in the same direction as the first pile yarn in a cut loop, said first and second tufted yarns being skewed between the first and second cotton layer materials.

Preferably, the first and second cotton layers have a shrink differential of preferably 20% to 30%.

It is also preferred that the tumble twist be on the side of the cotton layer having the lower shrink coefficient of the two layers.

The rug of this invention is made as follows. Two cotton layers having different shrink coefficients are placed one on the other to form a two layer backing material. Pile yarns are tufted through the backing material in two steps. First, one pile yarn is tufted through the double layer to form a high loop on one side of the backing and a cut loop on the other side of the backing. A second pile yarn is then tufted through the double backing material in the same direction as the first yarn to form a low loop on the same side as the high loop, and a cut loop on the other side. The tufted material is then pre-washed to shrink the two cotton layers. The layer with the higher shrink coefficient will form, upon shrinking, a tighter weave around the tufted yarns than the weave of the material with the lower shrinkage, resulting in a skewing of the yarns between the two cotton layers and tumble twisting of the high loop, due to their shrink differential.

The tufting does not have to be made in two steps, and both the tumble twist loops and cut loops may be tufted at the same time in one operation. Also the direction of the tufting can be from either side of the two layers, as long as all the tufts are in the same direction.

BRIEF DESCRIPTION OF THE DRAWINGS

The invention will be better understood in conjunction with the following drawings, in which.

DETAILED DESCRIPTION OF THE INVENTION

Figure 1:
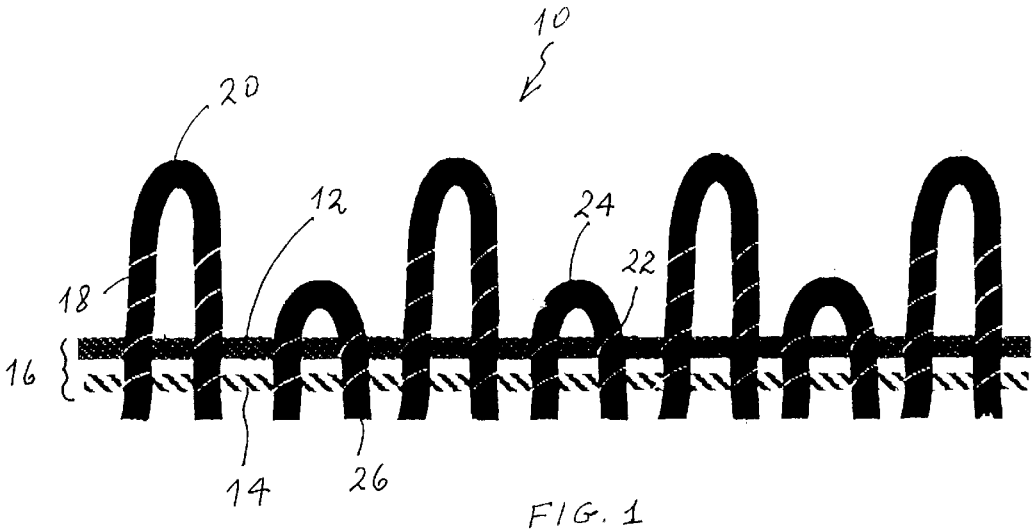
FIG. 1 illustrates the first stage of the two stage process for preparing a rug in accordance with the invention.
Figure 2:
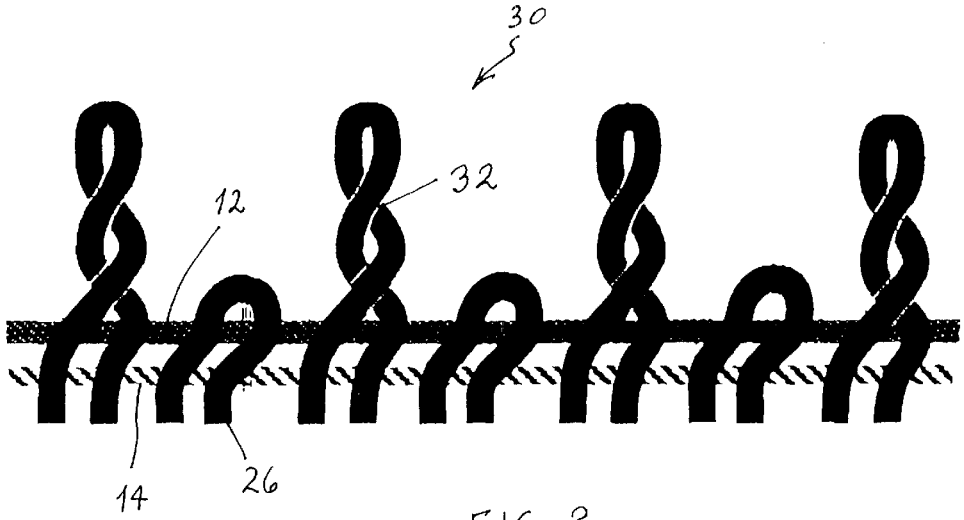
FIG. 2 shows the second, finishing stage of the process for making the rug according to the invention.

Referring now to FIGS. 1, there is shown the first stage for making a tufted precursor 10 of a rug according to the invention. Two layers of cotton material 12 and 14, each having a different shrink co-efficient, are placed one over the other to form a double layer backing material 16. A cotton yarn 18 is tufted through the double layer backing 16, first through upper layer 12 and then through lower layer 14, to give a high loop 20 on the surface of the upper layer 12 and a cut loop on the surface of the lower layer 14. A second cotton yarn 22 is tufted through the double layer backing material 16 in the same direction as the first yarn 18 to give a short loop 24 on the upper surface layer 12 and a cut loop 26 on the surface of the lower layer 14. The tufted precursor 10 itself cannot serve as a permanent rug because the yarns is easily pulled out from the backing material since there is no latex to adhere the yarn to the backing layer. The tufted precursor 10 is then subjected to a pre-wash which shrinks the cotton layers 12 and 14 to different degrees depending on their respective different shrink coefficients, resulting in a stable rug 30, shown in FIG. 2. Because of the pre-wash, the cotton layers 12 and 14 shrink to different degrees with one layer forming a tighter weave around the yarns 18 and 22 than the other layer, although both layers tighten their weave around these yarns, since both layers undergo shrinkage. The difference in shrinkage, however, causes the yarns 18 and 22 to skew between the layers 12 and 14 and the high loop 20 to twist to form a tumble twist loop 32.

It will be appreciated by persons skilled in the art that the scope of the present invention is not limited to what has been shown and described hereinabove, merely by way of example. Rather, the scope of the invention is limited solely by the claims which follow.

What is claimed is:

1. An integrally tufted tumble twist loop—cut loop reversible rug comprising:

a first layer of cotton material, a second layer of cotton material overlaying the first layer of cotton material thereby forming a two layer cotton backing material, said first and said second layers of cotton material having different shrink coefficients, a first pile yarn tufted through the two layer backing material in a tumble twist loop on one side and a cut loop on the other side of the backing material, a second pile yarn tufted through the two layer backing material in a cut loop on the other side of the backing material, said first and second tufted yarns being skewed between the first and the second cotton layer materials.

2. An integrally tufted tumble twist loop—cut loop reversible rug as in claim 1, wherein the first and second cotton layers have shrink coefficients differing by 20% to 30%.

3. An integrally tufted tumble twist loop—cut loop reversible rug as in claim 1, wherein the tumble twist loops are on the surface of the cotton layer material having the higher shrinkage.

4. An integrally tufted tumble twist loop—cut loop reversible rug as in claim 1, wherein the tumble twist loops are on the surface of the cotton layer material having the lower shrinkage.

5. A method of manufacturing an integrally tufted tumble twist loop—cut loop reversible rug comprising the steps:

a) providing a two layer cotton backing material, each cotton layer having a different shrink coefficient, b) tufting the two layer backing material with yarn to form first loops and second loops on one side of the backing, the first loops being higher than the second loops, and cut loops on the other side of the backing, c) washing the tufted material to shrink each cotton layer to a different degree, thereby tightening a weave around the yarns, skewing the yarns between the two layers of the backing material, and twisting the high loops into tumble twist loops.

6. A method as in claim 5, wherein the first and second cotton layers have shrink coefficients differing by 20% to 30%.

* * * * *